US012471692B2

(12) United States Patent
Wightman et al.

(10) Patent No.: US 12,471,692 B2
(45) Date of Patent: Nov. 18, 2025

(54) COSMETIC DISPENSER

(71) Applicant: AMPAC Limited, Taicang (CN)

(72) Inventors: James Christopher Wightman, Island Heights, NJ (US); Gary E. Myer, Hillsborough, NJ (US)

(73) Assignee: AMPAC Limited, Taicang (CN)

( * ) Notice: Subject to any disclaimer, the term of this patent is extended or adjusted under 35 U.S.C. 154(b) by 0 days.

(21) Appl. No.: 18/967,119

(22) Filed: Dec. 3, 2024

(65) Prior Publication Data

US 2025/0169593 A1 May 29, 2025

Related U.S. Application Data

(63) Continuation of application No. 18/030,119, filed as application No. PCT/US2021/053477 on Oct. 5, 2021.

(Continued)

(51) Int. Cl.

| | |
|---|---|
| ***A45D 40/06*** | (2006.01) |
| ***A45D 40/00*** | (2006.01) |
| ***B65D 65/46*** | (2006.01) |

(52) U.S. Cl.

CPC ..... *A45D 40/06* (2013.01); *B65D 65/466* (2013.01); *A45D 2040/0025* (2013.01); *B65D 2565/385* (2013.01)

(58) Field of Classification Search

CPC ..... A45D 40/06; A45D 2040/0025; A45D 40/00; A45D 2040/0062; A45D 40/02;

(Continued)

(56) References Cited

U.S. PATENT DOCUMENTS

| | | | |
|---|---|---|---|
| 2,896,778 | A | 7/1959 | Hopgood |
| 3,308,939 | A | 3/1967 | Sakalys |

(Continued)

FOREIGN PATENT DOCUMENTS

| | | | |
|---|---|---|---|
| GB | 927706 | A1 | 6/1963 |
| GB | 2432147 | A | 5/2007 |

(Continued)

OTHER PUBLICATIONS

Extended European Search Report for European Patent Application No. 21878321.5, mailed Oct. 4, 2024, 7 pages.

(Continued)

*Primary Examiner* — David J Walczak

(74) *Attorney, Agent, or Firm* — Lowenstein Sandler LLP

(57) ABSTRACT

A cosmetic dispenser includes a base that includes an interior surface that forms a spiral recess. The cosmetic dispenser further includes a pedestal assembly received within a cavity of the base. The pedestal assembly includes a pedestal including a base plate at a first distal end and a cup member at a second distal end opposite the first distal end. The cup member is configured to receive a cosmetic that extends above the cup member. The cosmetic dispenser further includes a sleeve movably received within the cavity. The sleeve includes at least one engaging component rotatably coupled to the base via the spiral recess. The engaging component is configured to move along the spiral recess to raise and lower the sleeve. The sleeve is configured to completely surround the cosmetic in a raised first position and at least partially expose the cosmetic in a lowered second position.

20 Claims, 4 Drawing Sheets

Related U.S. Application Data

(60) Provisional application No. 63/087,508, filed on Oct. 5, 2020.

(58) Field of Classification Search
CPC . A45D 40/04; B65D 65/466; B65D 2565/385
USPC ..... 401/68, 116, 117, 171, 176
See application file for complete search history.

(56) References Cited

U.S. PATENT DOCUMENTS

| | | | | |
|---|---|---|---|---|
| 3,317,036 | A * | 5/1967 | Cherba | A45D 40/06 401/172 |
| 4,180,163 | A * | 12/1979 | Grioni | A45D 40/06 206/385 |
| 5,423,622 | A | 6/1995 | Perrotti | |
| 6,226,311 | B1 | 5/2001 | Meliga | |
| 6,561,711 | B1 * | 5/2003 | Pierpont | A45D 40/06 401/98 |
| 8,226,311 | B2 * | 7/2012 | Cronin | A45D 40/26 401/262 |
| 2006/0188322 | A1 | 8/2006 | Dieudonat | |
| 2009/0162131 | A1 | 6/2009 | Thorpe | |
| 2013/0230347 | A1 | 9/2013 | Kim | |
| 2018/0072483 | A1 * | 3/2018 | Meranus | B65D 83/761 |
| 2023/0248134 | A1 * | 8/2023 | Skelton | A45D 40/065 401/88 |

FOREIGN PATENT DOCUMENTS

| | | | |
|---|---|---|---|
| KR | 200397589 | Y1 | 10/2005 |
| TW | 551069 | U | 9/2003 |
| WO | 2008111238 | A1 | 9/2008 |
| WO | 2020152224 | A1 | 7/2020 |

OTHER PUBLICATIONS

International Search report and Written Opinion for International Application No. PCT/US2021!053477, mailed Jan. 18. 2022, 20 pages.

English Translation of Search Report for TW Patent Application Serial No. 110137087, dated Jan. 15, 2025, 1 page.

* cited by examiner

COSMETIC DISPENSER

RELATED APPLICATIONS

This application is a continuation of U.S. patent application Ser. No. 18/030,119, filed Apr. 4, 2023, which is a National Stage of International Application No. PCT/US21/53477, filed Oct. 5, 2021, which claims the benefit under 35 U.S.C. § 119(e) of U.S. Provisional Patent Application No. 63/087,508 filed Oct. 5, 2020, which is incorporated by reference herein.

FIELD

The present disclosure relates generally to cosmetic dispensers for dispensing semi-solid cosmetics, for example, lipstick, chap stick, lip gloss, blush stick, foundation stick, eyeliner, eye shadow, deodorant and antiperspirant. Also disclosed are methods of preparation of the cosmetic dispenser.

BACKGROUND

Cosmetics, such as lipsticks, chap sticks, lip glosses, blush sticks, foundation sticks, eyeliners, eye shadows, deodorants and antiperspirants, can be applied using a finger, a brush and/or through the use of a cosmetic dispenser. For example, lipsticks may be applied through the use of a lip applicator that has a receptacle for a stick of lip composition. The receptacle may be coupled to a mechanism for extending the lipstick from and retracting the lipstick into a base of the applicator as the lip composition is to be used or stored protecting the delicate, semi-solid stick when not in use.

The dispenser may also include a cover over the base for further protecting the lipstick when not in use. The cover is typically made of a non-transparent material such that consumers and users are unable to view the color or type of stick requiring the consumer or user to remove the lid to inspect. Another problem with conventional lipstick dispensers arises when the user fails to return the stick to a recessed position after use. In these situations, the stick can become smudged, smashed or lose its shape if the cap is placed on the extended lipstick. Likewise, when a lipstick is purchased, it is pre-shaped to a point or the stick is angled to permit the user to apply the lipstick in the desired manner. As time goes on, however, the lipstick, because it is relatively soft, has a tendency to lose its initial crisp point or angle. As a result, upon application, the user may experience difficulty obtaining clean lines. At this point, the user may dispose of the product before the lipstick is completely used or may attempt to reshape the tip.

Many consumers are very particular in selecting lipstick color. Color selection is based on individual taste where a person has a preference for certain colors over others. Fashion also may be a factor—there are some colors that may be "in" at a point of time. Consumers may carry multiple shades of lipstick in a handbag to ensure that there is an appropriate shade for an occasion or attire. However, if the lip product is concealed beneath a solid or opaque lid, the consumer may have to rifle through the handbag removing lids to find a desired shade.

Further, conventional cosmetic dispensers, such as lipstick dispensers, are formed of components typically made of plastic materials that do not naturally decompose. As such, conventional lipstick dispensers are environmental pollutants. For example, the incineration of such dispensers produces harmful gases that are discharged into the atmosphere and these non-degradable products take up valuable space in landfills.

There remains a need for improved cosmetic dispensers that aesthetically enable users to view and quickly select a shade. There is a further need for cosmetic dispensers that reduce the production and consumption of plastic materials.

BRIEF SUMMARY

According to embodiments, disclosed herein is a cosmetic dispenser, comprising: a base comprising a cavity and an interior surface, wherein the interior surface comprises a spiral recess; a pedestal assembly received within the cavity of the base, the pedestal assembly comprising a pedestal comprising a base plate at a first distal end of the pedestal and a cup member at a second distal end opposite the first distal end, wherein the cup member is configured to receive a cosmetic that extends above the cup member; and a sleeve movably received within the cavity, the sleeve comprising at least one engaging means coupled to the spiral recess, wherein the engaging means is configured to slide along the spiral recess to raise and lower the sleeve, wherein the sleeve is configured to completely surround the cosmetic in a raised first position, and is configured to at least partially expose the cosmetic in a lowered second position. In embodiments, the spiral recess is integral with the interior surface of the base.

In further embodiments, the pedestal and the base form a solid machined component. In yet further embodiments, the cup member is removably attached to the pedestal. According to further embodiments, the cup member comprises a receiving means configured to mate with the second distal end of the pedestal or wherein the cup member comprises a threading means configured to couple with a thread around the second distal end of the pedestal. In embodiments, the base plate is configured to seat on a bottom floor of the cavity. In further embodiments, cosmetic is received within the cup and extends above the cup. According to embodiments, the sleeve is transparent and optionally, the cup member is transparent, and optionally, the base is transparent. In embodiments, the cosmetic dispenser further comprises a lid configured to mate with the base. In embodiments the lid is transparent. In further embodiments, at least one of the base, the pedestal, the base plate, the cup member or the sleeve comprises at least one material selected from the group consisting of a biodegradable material, a recycled material, a recyclable material, an environmentally friendly material, composites of any of the foregoing, laminates of any of the foregoing and combinations of any of the foregoing, optionally, the at least one material comprises polyhydroxyalkanoate (PHA). In embodiments, the material is transparent.

According to further embodiments, the at least one of the base, the pedestal, the base plate, the cup member or the sleeve comprises at least one material selected from the group consisting of a polymer, paper, metal, glass, foam, fabric, composites of any of the foregoing, laminates of any of the foregoing and combinations of any of the foregoing. In embodiments, the material comprises a polymer selected from a group consisting of an elastomer, an oriented polyester, an un-oriented polyesters a co-polyester, polyethylene terephthalate (PET), polyethylene terephthalate glycol (PETG), polyethylene furanoate (PEF), polybutylene terephthalate (PBT), polylactic acid (PLA), a nylon, a polyamide, polyethylene, polypropylene, a cellulose, a cellulosic ester, polyhydroxyalkanoate (PHA), polyvinyl chloride (PVC), ionomers, sodium ionomer, zinc ionomer, thermoplastic starch, a polyolefin, a cyclic polyolefin, a linear low density polyethylene (LLDPE), a low density polyethylene (LDPE), a high density polyethylene (HDPE), a medium density polyethylene (MDPE), polyoxymethylene (POM), polyphenylene sulfide (PPS), polyetherketone (PEK), ethylene vinyl acetate (EVA), ethylene acrylic acid (EAA), polyether ether ketone (PEEK), a homopolymer, a copolymer, blends, combinations, laminates, microlayers, nanolayers, coextrusions thereof and combinations thereof. According to further embodiments, the material comprises a paper comprising at least one of a plant material, cardboard, paperboard, pressed paper, wax paper, paper Mache, wood fiber, cellulose, sawdust, hemp, hemp fiber, laminates thereof, composites thereof and combinations thereof. In yet further embodiments, the material comprises a metal selected from a group consisting of aluminum, tin, stainless steel, ceramics, metal oxides, silica, alumina, alloys thereof, anodized metals thereof, laminates thereof and combinations thereof. The metal may be comprised in a mixture with at least one of paper or a polymer and wherein the mixture is at least one of biodegradable, recyclable or environmentally friendly. The material may include a glass selected from a group consisting of strengthened glass, reinforced glass, silica glass, aluminosilicate glass, borosilicate glass, tempered glass and combinations thereof. The glass can be comprised in a mixture with at least one of paper, a metal or a polymer and wherein the mixture is at least one of biodegradable, recyclable or environmentally friendly. According to further embodiments, the fabric is selected from a group consisting of woven materials, non-woven materials, cotton, wool, hemp, rayon, polyester, paper and fiber combinations, laminates thereof and combinations thereof.

BRIEF DESCRIPTION OF THE DRAWINGS

The present disclosure will be more readily understood from the detailed description of examples presented below considered in conjunction with the attached drawings, of which.

DETAILED DESCRIPTION

Definitions

Figure 1E:
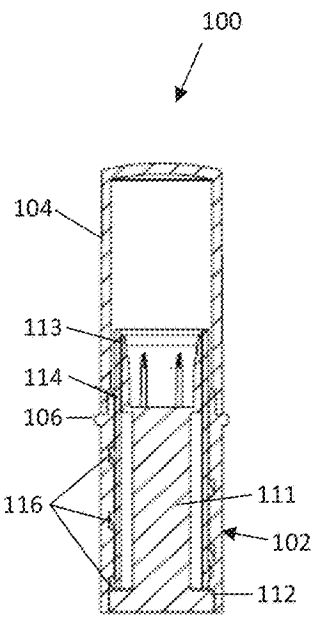
FIG. 1E is a side view of a schematic showing an embodiment of a cup of a cosmetic dispenser assembly according to the disclosure.

Reference throughout this specification to, for example, "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

As used herein, the singular forms "a," "an," and "the" include plural references unless the context clearly indicates otherwise. Thus, for example, reference to "a lift pin" includes a single lift pin as well as more than one lift pin.

As used herein, the term "about" in connection with a measured quantity, refers to the normal variations in that measured quantity as expected by one of ordinary skill in the art in making the measurement and exercising a level of care commensurate with the objective of measurement and the precision of the measuring equipment. In certain embodiments, the term "about" includes the recited number±10%, such that "about 10" would include from 9 to 11.

The term "at least about" in connection with a measured quantity refers to the normal variations in the measured quantity, as expected by one of ordinary skill in the art in making the measurement and exercising a level of care commensurate with the objective of measurement and precisions of the measuring equipment and any quantities higher than that. In certain embodiments, the term "at least about" includes the recited number minus 10% and any quantity that is higher such that "at least about 10" would include 9 and anything greater than 9. This term can also be expressed as "about 10 or more." Similarly, the term "less than about" typically includes the recited number plus 10% and any quantity that is lower such that "less than about 10" would include 11 and anything less than 11. This term can also be expressed as "about 10 or less."

Unless otherwise indicated, all parts and percentages are by weight. Weight percent (wt. %), if not otherwise indicated, is based on an entire composition free of any volatiles, that is, based on dry solids content.

The term "cosmetic" as used herein refers to an article that may be as defined under the Federal Food, Drug, and Cosmetic act (FD&C Act) by its intended use, as "articles intended to be rubbed, poured, sprinkled, or sprayed on, introduced into, or otherwise applied to the human body . . . for cleansing, beautifying, promoting attractiveness, or altering the appearance." FD&C Act, § 201(i). Products included in this definition may include skin moisturizers, perfumes, lipsticks, fingernail polishes, eye and facial makeup preparations, cleansing shampoos, permanent waves, hair colors, and deodorants, as well as any substance intended for use as a component of a cosmetic product. For the purposes of this disclosure, the term "cosmetic" may include, but is not limited to charge, portion, segment, or stick of a composition, lipstick, chap stick, lip gloss, blush stick, foundation stick, an eyeliner, eye shadow, deodorant and/or antiperspirant.

Cosmetic Dispenser

Embodiments of cosmetic dispensers as described herein may utilize fewer parts than other known dispensers, and may be formed of recycled and/or recyclable materials. In embodiments, cosmetic dispensers as disclosed herein can reduce the amount of plastic that ends-up in landfills. In embodiments, components of the cosmetic dispensers are transparent or see-through enabling users to quickly determine the color and/or type of cosmetic contained therein. In embodiments, the cover of a cosmetic dispenser as described herein may be made of a clear material to permit a user and/or purchaser to view the color of the stick of cosmetic and/or whether it has been damaged or tampered with prior to use.

Cosmetic dispensers as described herein may be constructed of only four (4) injection molded components, whereas most current designs are constructed of six (6) to seven (7) components. The reduction in the number of plastic components and use of post-consumer recycled (PCR) plastic materials, can markedly reduce the amount of greenhouse gases and waste of these cosmetic dispensers as compared to a typical lipstick dispenser. For example, a cosmetic dispenser as described herein can contain up to 85% less $CO_2$ emission per piece as compared to a known benchmark lipstick dispenser (e.g., 0.01 kg of $CO_2$ per piece as compared to 0.065 kg $CO_2$ per piece for a benchmark dispenser). Furthermore, a cosmetic dispenser as described herein can contain up to 12% less plastic per piece as compared to a known benchmark lipstick dispenser (e.g., 10.9 g of plastic per piece as compared to 12.4 g plastic per piece for a benchmark dispenser).

All components of the cosmetic dispenser may be manufactured from the same biodegradable, recycled and/or recyclable material, which can simplify the ease of recycling with no disassembly required by the consumer. In embodiments where polypropylene (PP) or polyethylene terephthalate (PET) materials are used to mold the components of the cosmetic dispenser, the cosmetic dispenser is readily recyclable. Cosmetic dispensers as described herein may contain up to 100% post-consumer recycled content.

An example embodiment of a cosmetic dispenser 100 is shown in FIGS. 1A-1E. In the illustrated embodiment, the cosmetic dispenser 100 has a base 102 configured to house components of a dispensing mechanism 110. The shape of the external surface of base 102 and of a bottom side 103 of base 102 can be of any suitable geometry known to those of ordinary skill in the art. For example, base 102 and bottom side 103 may be square, rectangular, a rounded square, a rounded rectangle, triangular, a rounded triangle, a star, a diamond and so on. In embodiments, the base 102 may include a collar 106 about a top portion 105 thereof. In embodiments, bottom side 103 of base 102 may be a solid circular wall and may be integrally formed (e.g., molded) with a solid body 107 of base 102. Collar 106 may protrude outwardly from the top portion 105 of base 102 forming a seat on which a lid 104 can rest when assembled with base 102. In embodiments, the shape of the external surface of lid 104 can be of any suitable geometry known to those of ordinary skill in the art. For example, lid 104 may be square, rectangular, a rounded square, a rounded rectangle, triangular, a rounded triangle, a star, a diamond and so on. When lid 104 is removably attached to base 102, the protrusion of collar 106 may span the circumference of the cosmetic dispenser 100. Collar 106 may further include member 109 perpendicularly affixed to collar 106. Lid 104 may slide over member 109 to assemble lid 104 to base 102. In embodiments, member 109 may be threaded or textured and configured to mate with corresponding components (e.g., threading, protrusions, etc.) within the inner surface of lid 104 to secure lid 104 to base 102. Lid 104 together with base 102 and collar 106 form an outer housing of cosmetic dispenser 100. In embodiments, the lid 104 and base 102 may be coupled and/or decoupled via magnets. For example, a magnetic material (e.g., a catch or plate) may be attached to the lid 104 or base 102 and configured to mate with a magnetically attractive material (e.g., steel, iron alloy, etc.) on the base 102 or lid 104, respectively. In further embodiments, the lid 104 may be coupled to base 102 via any suitable method known to those of ordinary skill in the art including snap fitting, arrowhead fitting and press fitting, etc. may be used in various embodiments, either in combination with those described herein, or in other combinations.

Figure 1D:
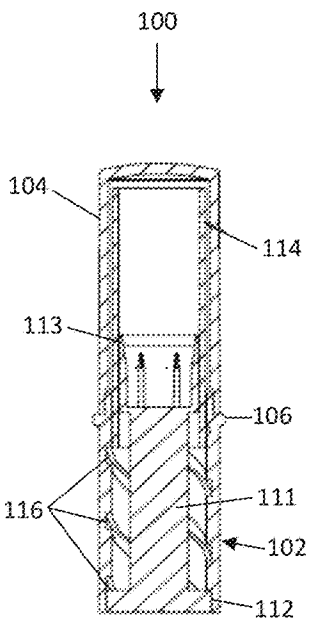
FIG. 1D is a side view of a schematic showing an embodiment of a cosmetic dispenser assembly according to the disclosure.
Figure 1C:
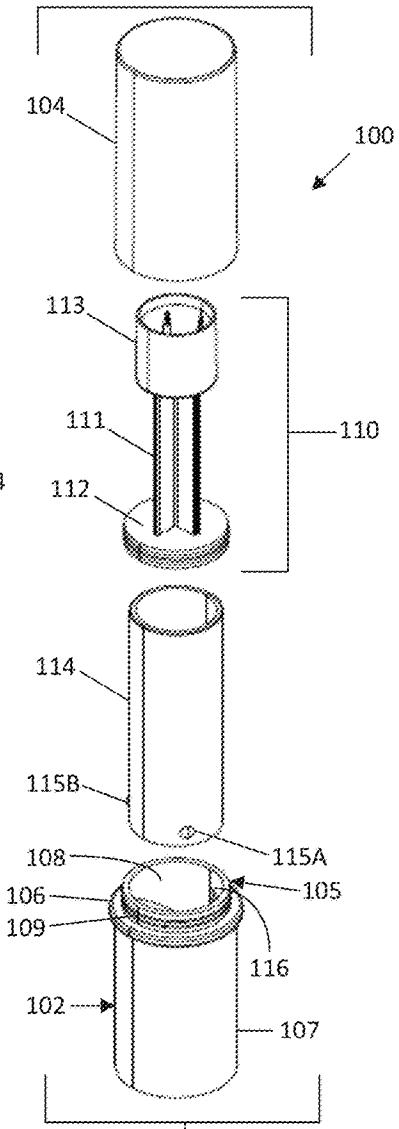
FIG. 1C is an exploded view showing an embodiment of a cosmetic dispenser according to the disclosure.
Figure 1B:
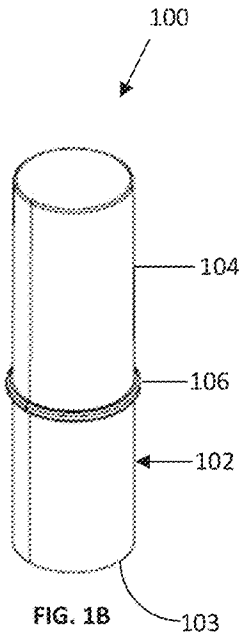
FIG. 1B is a side view showing an embodiment of a cosmetic dispenser according to the disclosure.
Figure 1A:
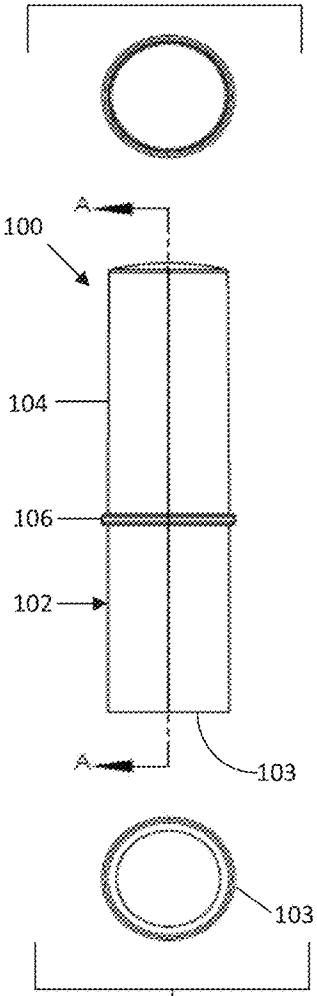
FIG. 1A is a side view of an embodiment of a cosmetic dispenser system according to the disclosure.

The top portion 105 of base 102 includes an opening 108 configured to receive components of a dispensing mechanism 110. The interior surface of base 102 may form a hollow cylinder (i.e., a cylindrical cavity) configured to receive components (e.g., cylindrical components) of the dispensing mechanism 110. Dispensing mechanism 110 can include a pedestal assembly including a pedestal 111 attached to which is a base plate 112 and a cup 113. The pedestal assembly may be received in the hollow base 102 as shown in FIGS. 1D and 1E. Base plate 112, positioned at one end of the pedestal 111, may rest on the interior surface of the bottom side 103 of base 102. Cup 113 may be attached (e.g., removably attached) to pedestal 111 at the end opposite base plate 112. When received in hollow base 102, cup 113 may rest above the top portion 105 of base 102 as shown in FIGS. 1D and 1E. A sleeve 114 may overlay pedestal 111 such that a bottom of sleeve 114 rests on base plate 112. When assembled with lid 104 removably attached to base 102, cup 113 and cosmetic (not shown) contained therein may be received within sleeve 114. Lid 104 may be a hollow cylinder configured to receive cup 113 and a cosmetic (not shown) received therein.

As shown in FIGS. 1D and 1E, sleeve 114 is configured to rotate up and down around pedestal 111, cup 113 and a cosmetic (not shown) contained therein. Sliding members 115A, 115B may be received within sliding mechanism 116, which spirals along an interior surface of base 102. Sliding mechanism 116 may be formed (e.g., molded) within the interior surface of base 102. While dispensing mechanism 110 with cosmetic contained therein remains stationary, sleeve 114 may rotate up and down around the cosmetic and cup 113. When in a raised position, as shown in FIG. 1D, sleeve 114 covers and protects cup 113 having cosmetic, for example, a semi-solid cylindrical stick of a cosmetic (not shown), received therein. When in a lowered position, as shown in FIG. 1E, sleeve 114 exposes the cosmetic enabling application by a user.

Another example embodiment of a cosmetic dispenser 200 is shown in FIGS. 2A-2E. In the illustrated embodiment, the cosmetic dispenser 200 has a base 202 configured to house components of a dispensing mechanism 210. The shape of the external surface of base 202 and of a bottom side 203 can be of any suitable geometry known to those of ordinary skill in the art. For example, base 202 and bottom side 203 may be square, rectangular, a rounded square, a rounded rectangle, triangular, a rounded triangle, a star, a diamond and so on. In embodiments, bottom side 203 of base 202 may be a solid circular wall and may be integrally formed (e.g., molded) with a solid cylindrical body 207 of the base 202. In embodiments, the base 202 may include a seat 206 about a top portion 205 thereof. Seat 206 forms a base on which a lid 204 can rest when assembled with base 202. Collar 209 may extend perpendicularly from seat 206. Lid 204 may slide over collar 209 to couple to base 202 forming a smooth seamless outer casing. In embodiments, collar 209 may include a locking member 217 (e.g., a protruding dome or a divot) configured to mate with a corresponding engaging member (not shown) within the inner surface of lid 204 to secure lid 204 to base 202. Lid 204 together with base 202 form an outer housing of cosmetic dispenser 200. In embodiments, the lid 204 and base 202 may be coupled and/or decoupled via magnets. For example, a magnetic material (e.g., a catch or plate) may be attached to the lid 204 or base 202 and configured to mate with a magnetically attractive material (e.g., steel, iron alloy, etc.) on the base 202 or lid 204, respectively. In further embodiments, the lid 204 may be coupled to base 202 via any suitable method known to those of ordinary skill in the art including snap fitting, arrowhead fitting and press fitting, etc. may be used in various embodiments, either in combination with those described herein, or in other combinations.

Figure 2E:
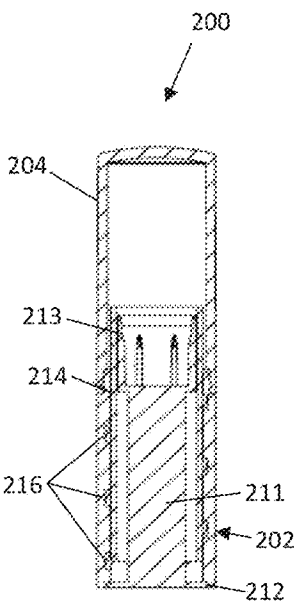
FIG. 2E is a side view of a schematic showing various example aspects of a cosmetic dispensers according to the disclosure.
Figure 2D:
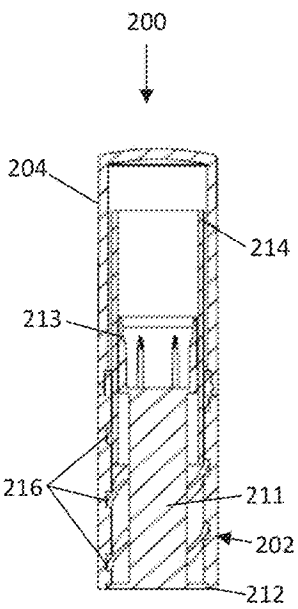
FIG. 2D is a side view of a schematic showing various example aspects of a cosmetic dispenser according to the disclosure.
Figure 2C:
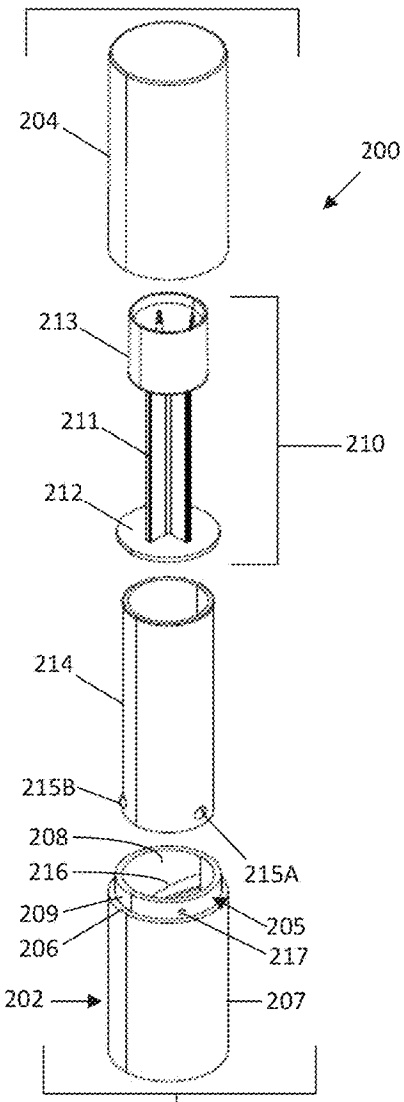
FIG. 2C is an exploded view showing an embodiment of a cosmetic dispenser according to the disclosure.
Figure 2B:
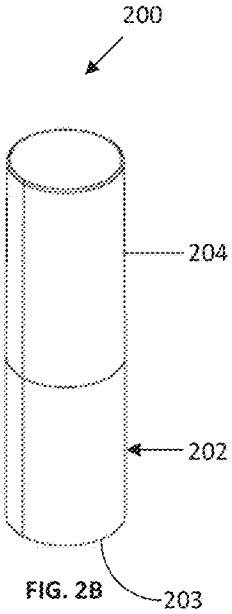
FIG. 2B is a side view showing an embodiment of a cosmetic dispenser according to the disclosure.
Figure 2A:
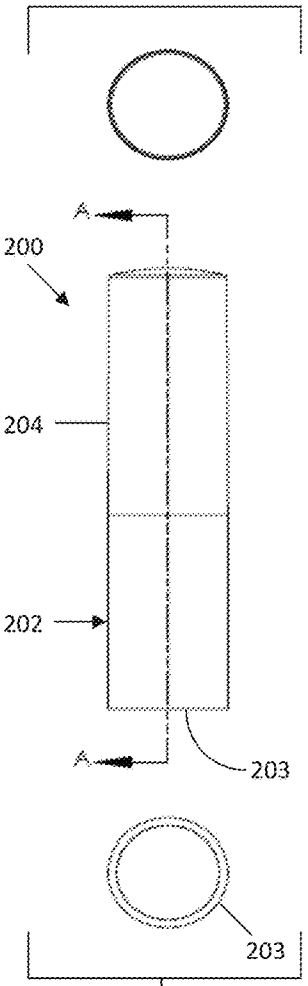
FIG. 2A is a side view showing an embodiment of a cosmetic dispenser according to the disclosure.

The top portion 205 of base 202 includes an opening 208 configured to receive components of a dispensing mechanism 210. Base 202 may form a hollow cylinder configured to receive cylindrical components of the dispensing mechanism 210. Dispensing mechanism 210 can include a pedestal assembly including a pedestal 211 attached to which is a base plate 212 and a cup 213. The pedestal assembly may be received in the hollow base 202 as shown in FIGS. 2D and 2E. Base plate 212, positioned at one end of the pedestal 211, may rest on the interior surface of the bottom side 203 of base 202. Cup 213 may be attached (e.g., removably attached) to pedestal 211 at the end opposite base plate 212. When received in hollow base 202, cup 213 may rest above the top portion 205 of base 202 as shown in FIGS. 2D and 2E. A hollow cylindrical sleeve 214 may overlay pedestal 211 such that a bottom of sleeve 214 rests on base plate 212. When assembled with lid 204 removably attached to base 202, cup 213 and cosmetic (not shown) contained therein may be received within sleeve 214. Lid 204 may be a hollow cylinder configured to receive cup 213 and a cosmetic (not shown) received therein.

As shown in FIGS. 2D and 2E, sleeve 214 is configured to rotate up and down around pedestal 211, cup 213 and a cosmetic (not shown) contained therein. Sliding members 215A, 215B may be received within sliding mechanism 216, which spirals along an interior surface of base 202. Sliding mechanism 216 may be formed (e.g., molded) within the interior surface of base 202. While dispensing mechanism 210 with cosmetic contained therein remains stationary, sleeve 214 may rotate up and down around the cosmetic and cup 213. When in a raised position, as shown in FIG. 2D, sleeve 214 covers and protects cup 213 having cosmetic, for example, a semi-solid cylindrical stick of a cosmetic (not shown), received therein. When in a lowered position, as shown in FIG. 2E, sleeve 214 exposes the cosmetic enabling application by a user.

In embodiments, the cosmetic dispenser of FIGS. 2A-2E, may be configured to dispense any semi-solid cosmetic known to those of ordinary skill in the art. In embodiments, the cosmetic dispenser may be configured to dispense a lipstick as shown in FIGS. 3A-3E or a deodorant as shown in FIGS. 4A-4C. With reference to FIGS. 3A-3E, the cosmetic dispensers 300A-300E each has a base 302A-302E configured to house components of the dispensing mechanism. In embodiments, base 302A, 302B is clear and transparent and configured to display a portion of the lipstick 318A-318E therein. Collar 309A-309E extends perpendicularly from the seat of base 302A-302E. Lid 304A-304E may slide over collar 309A-309E to couple the lid to base 302A-302E forming a smooth seamless outer casing. As shown in the illustrated embodiments, lid 304A-304E together with corresponding base 302A-302E form an outer housing of cosmetic dispenser 300A-300E.

Figures 3A, 3B, 3C, 3D, 3E:
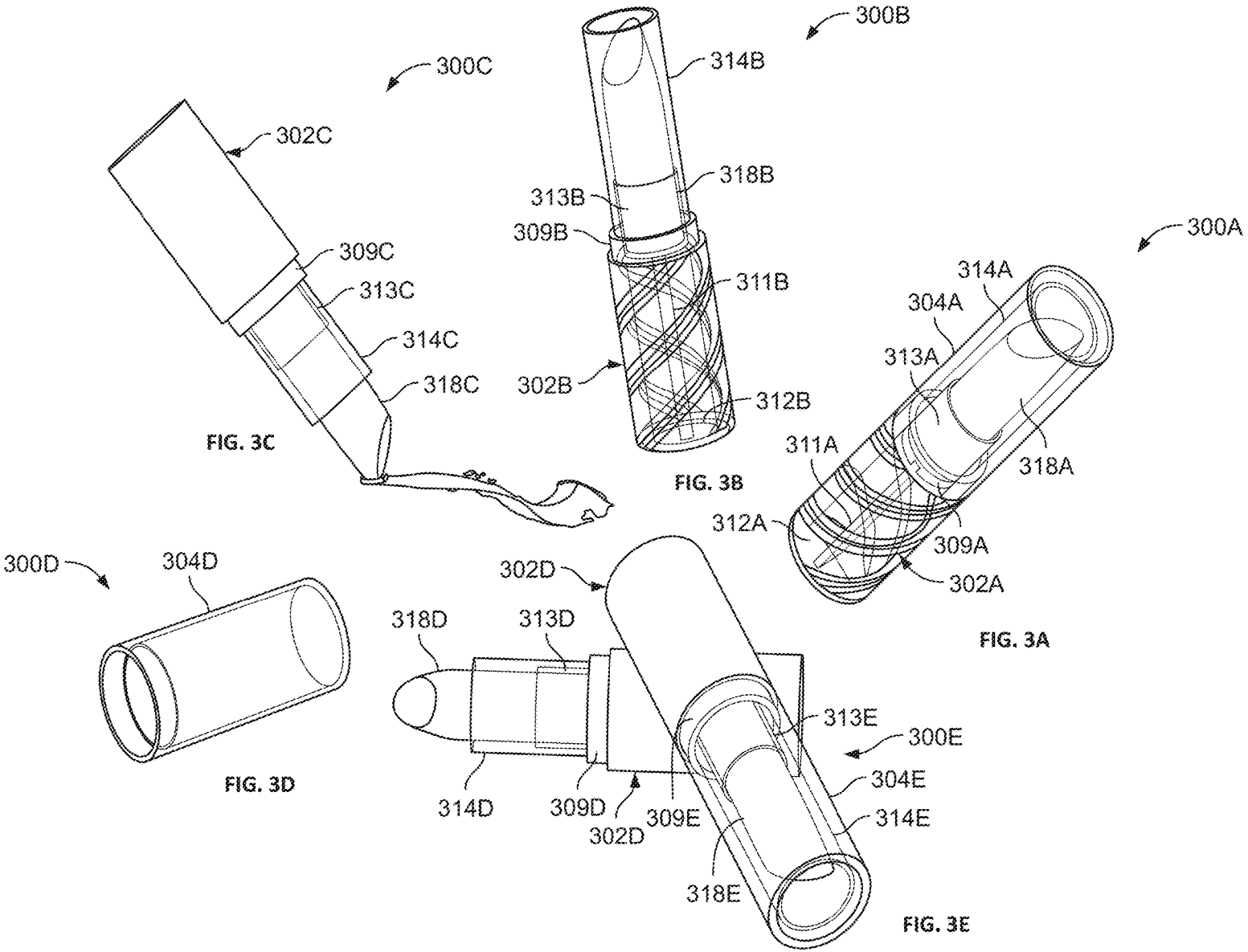
FIG. 3A is an image showing an embodiment of a lipstick dispenser as described in embodiments herein.
FIG. 3B is an image showing an embodiment of a lipstick dispenser as described in embodiments herein.
FIG. 3C is an image showing an embodiment of a lipstick dispenser as described in embodiments herein.
FIG. 3D is an image showing an embodiment of a lipstick dispenser as described in embodiments herein.
FIG. 3E is an image showing an embodiment of a lipstick dispenser as described in embodiments herein.
Figure 4A:
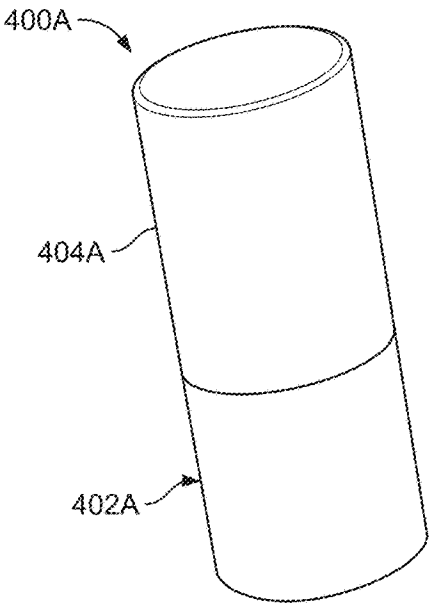
FIG. 4A is an image showing an embodiment of a deodorant dispenser as described in embodiments herein.
Figure 4B:
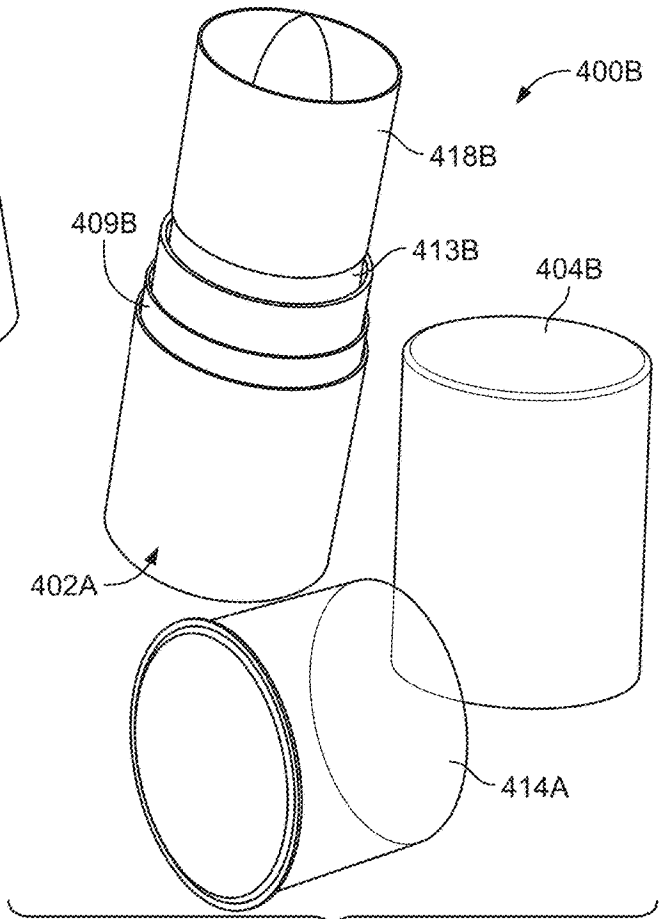
FIG. 4B is an image showing an embodiment of a deodorant dispenser as described in embodiments herein.
Figure 4C:
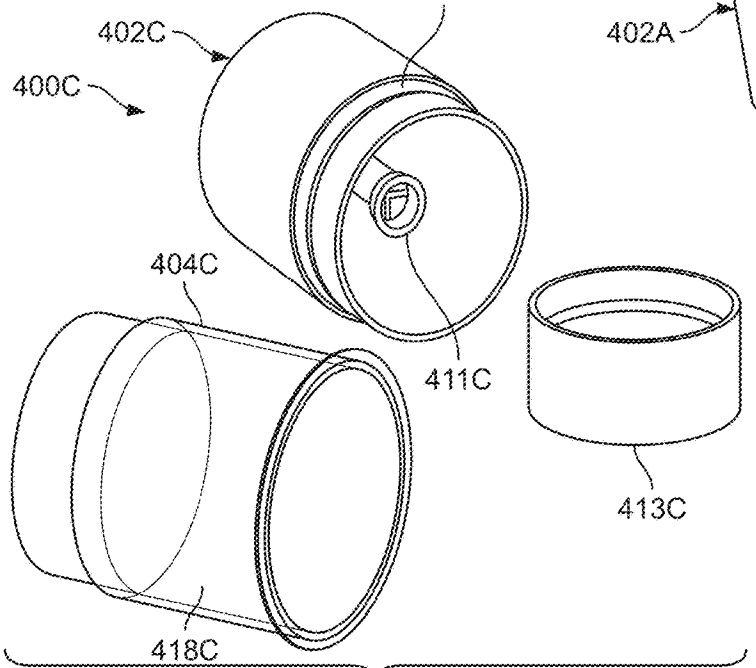
FIG. 4C is an image showing an embodiment of a deodorant dispenser as described in embodiments herein.

Cosmetic dispensers 300A-300E each include a pedestal 311A, 311B visible in FIGS. 3A, 3B attached to each which is a base plate 312A, 312B shown in FIGS. 3A, 3B and a cup 313A-313E. As shown in the illustrated embodiments, cup 313A-313E may be clear and transparent to show the lipstick through the lid 304A-304E. When assembled with lid 304A-304E removably attached to base 302A-302E, cup 313A-313E and the lipstick 318A-318E contained therein may be received within sleeve 314A-314E.

As shown in the illustrated embodiments in FIGS. 3A-3E, the lipsticks are visible semi-solid sticks of cosmetic with an angled end to aid in application. The transparent lids 304A-304E readily show that each lipstick is a different color.

With reference to FIGS. 4A-4C, the cosmetic dispensers 400A-400C each has a base 402A-402C configured to house components of the dispensing mechanism. Collar 409A-409C extends perpendicularly from the seat of base 402A-402C. Lid 404A-404C may slide over collar 409A-409C to couple the lid to base 402A-402C forming a smooth seamless outer casing. As shown in the illustrated embodiments, lid 404A-404C together with corresponding base 402A-402C form an outer housing of cosmetic dispenser 400A-400C.

Cosmetic dispensers 400A-400C each include a pedestal 411C visible in FIG. 4C attached to each which is a base plate (not shown) and a cup 413A-413C. As shown in the illustrated embodiments, cup 413A-413C may be clear and transparent to show the lipstick through the lid 404A-404C. When assembled with lid 404A-404C removably attached to base 402A-402C, cup 413A-413C and the deodorant 418A-418C contained therein may be received within sleeve 414A-414C.

As shown in the illustrated embodiments in FIGS. 4A, 4C, the lipsticks are visible are semi-solid sticks of cosmetic with an angled end to aid in application. The transparent lids 304A-304E readily show that each lipstick is a different color.

Lid 104, 204, 304, 404 may be formed of any suitable material known to those of ordinary skill in the art. In embodiments, lid 104, 204, 304, 404 may be formed of a material including, but not limited to polymers, paper, metal, glass, foams, fabrics, composites of any of the foregoing, laminates of any of the foregoing and combinations of any of the foregoing.

According to embodiments, the material may be biodegradable, recycled, recyclable, environmentally friendly and combinations thereof. The term "biodegradable plastic" as used herein refers a substance or object capable of being decomposed by bacteria or other living organisms, and/or a material that meets the ASTM D6400 test to certify if a produce can be composted. The term "biodegradable plastic" as used herein refers to a material that meets the ASTM D6868 test to determine if a biodegradable plastic is truly biodegradable. The term "recycled" as used herein refers to a material that has been converted from waste to usable material. The term "recyclable" as used herein refers to a substance or object that can be recycled. The term "environmentally friendly" as used herein refers to a material that when decomposed is not an environmental pollutant. In embodiments, an environmentally friendly paper material as described herein may be easily disposed of by nature or incineration, without producing substances detrimental to the environment.

According to embodiments, one or more of the components of cosmetic dispenser 100, 200 may be formed of a clear or transparent material. In embodiments, the clear or transparent material is biodegradable, recycled, recyclable, environmentally friendly and/or combinations thereof. In embodiments, the lid 104, 204, 304, 404 and the sleeve 114, 214, 314, 414 are formed of the clear or transparent material that is biodegradable, recycled, recyclable and/or environmentally friendly.

Suitable polymers include, but are not limited to, elastomers, oriented and un-oriented polyesters, co-polyesters, polyethylene terephthalate (PET), co-polyesters, polyethylene terephthalate glycol (PETG), polyethylene furanoate (PEF), polybutylene terephthalate (PBT), polylactic acid (PLA), nylons, polyamides, polyethylene, polypropylene, oriented polypropylene, celluloses, cellulosic esters, polyhydroxyalkanoate (PHA), polyvinyl chloride (PVC), ionomers, sodium ionomer, zinc ionomer, thermoplastic starch, polyolefins, cyclic polyolefins, polypropylene (PP), linear low density polyethylene (LLDPE), low density polyethylene (LDPE), high density polyethylene (HDPE), medium density polyethylene (MDPE), polyoxymethylene (POM), polyphenylene sulfide (PPS), polyetherketone (PEK), ethylene vinyl acetate (EVA), ethylene acrylic acid (EAA), polyether ether ketone (PEEK), homopolymers, copolymers, blends, combinations, laminates, microlayers, nanolayers, and coextrusions thereof. The polymer materials may be bio-based, petro-based, recycled and/or reground. The materials listed could be bio-based, petro based and recycled/reground. Resins could be foamed.

Suitable papers include, but are not limited to plant materials, cardboard, paperboard, pressed paper, wax paper, paper Mache, wood fiber, cellulose, sawdust, hemp, hemp fiber and combinations thereof. Paper materials may further include additives, binders, fillers and pigments.

Suitable metals include, but are not limited to aluminum, tin, stainless steel, ceramics, metal oxides, silica, alumina, alloys thereof, anodized metals thereof, laminates thereof and combinations thereof. In embodiments, the metals may be mixed with other materials including papers and polymers as described above to form biodegradable, recyclable and/or environmentally friendly materials.

Suitable glasses include, but are not limited to, strengthened glass, reinforced glass, silica glass, aluminosilicate glass, borosilicate glass, tempered glass and combinations thereof. The glass materials may be combined with other materials as described herein to form biodegradable, recyclable and/or environmentally friendly materials.

Suitable fabrics include, but are not limited to, woven materials, non-woven materials, cotton, hemp, rayon, polyester, paper/fiber combinations, laminates thereof and combinations thereof. The fabrics may be reinforced with thickening additives including, but not limited to, waxes, glues, epoxies, and plaster of Paris.

Each of the components of the cosmetic dispenser 100, 200 may be constructed of at least one biodegradable polymer or a recycled composition such as a recycled resin. Suitable biodegradable plastics include, but are not limited to, plastics meeting ASTM D6400-04 Standard Specification for Compostable Plastics. Desirably, a biodegradable plastic is fully biodegradable, and is not just fragmented into very small particles upon biodegradation. An example of such fully biodegradable plastic is polyhydroxyalkanoate (PHA) materials.

The cosmetic may be any semi-solid material suitable for use as a cosmetic known to those of ordinary skill in the art. The cosmetic may be in the form of a stick with an angled, rounded or shaped end to enable application of the cosmetic to a body part. Suitable cosmetics include, but are not limited to, lipstick, chap stick, lip gloss, blush stick, foundation sticks, eyeliner, eye shadow or deodorant. According to certain embodiments, the cosmetic is a lipstick or blush stick.

Methods of Preparation

According to various embodiments, cosmetic dispensers according to embodiments herein, can be manufactured using any suitable methods known to those of ordinary skill in the art. In embodiments, components of the cosmetic dispensers can be manufactured using three-dimensional printing, injection-molding, extrusion and combinations thereof. Manufacturing techniques such as assembly line construction can be used to assemble the components of the cosmetic dispensers.

In some embodiments, the components of the cosmetic dispensers as described herein may be injection molded. Injection molding includes molding a molten plastic composition, under pressure, into an intended shape. The resulting injection molded pieces are configured to, for example, snap together without the use of any additional mechanical component such as a mechanical fastener or adhesive. In embodiments, cosmetic dispensers as disclosed herein may be constructed of four (4) injection molded components and free of adhesive and/or a mechanical fastener including, but not limited to, a screw, bolt, hinge and/or combinations thereof.

In some embodiments, a method of preparing a cosmetic dispenser (e.g., a lipstick dispenser) as described herein includes using injection molding to form four (4) components: a cup assembly, a base, a sleeve and a lid. In some embodiments, the components may be injection molded at a temperature of about 50° C. to about 400° C. and/or a pressure of about 20 MPa to about 200 MPa. The material properties of hardness, density, porosity, tensile strength and roughness may be maintained for the materials presented herein. In some embodiments, the components may be extrusion molded at a temperature of about 130° C. to about 250° C.

The method may further include inserting the sleeve into the base. The sleeve may be inserted into the bottom of the base and pulled partially through the top of the base. The sleeve can be configured to snap into place inside the base. The cup assembly may then be inserted through the bottom of the base so that the cup extends into the sleeve and the pedestal is within the interior of the base. The base plate of the cup assembly may be configured to seat within the bottom of the base. The lid can then be removably attached to the base. In embodiments, a stick composition may then be inserted into the cup, for example, after lowering the sleeve. The sleeve may configured to move up and down—in an up position the sleeve largely surrounds the stick composition, and in a down position, the sleeve exposes the stick composition.

EXAMPLES

Example 1—Preparation of a Lipstick Dispenser (Prophetic)

Use of pliable materials such as PP or PE can allow the design of a tighter snap feature between the base and cup as well as the cap to base enabling an airtight or leaktight seal. Use of such seals may be needed for long-wear or smudge-proof formulas containing raw materials such as isododecane or isohexadecane (non-aqueous ingredients). These materials and sealing attributes are also useful for highly aqueous formulas in preventing them from drying and losing performance attributes. Most classical lipstick formulas tend to be wax based and therefore do not often require these materials nor sealing attribute. However, many newer formulas are moving in this direction of require airtight sealing attributes.

Although exemplary systems have been described in language specific to structural features and/or methodological acts, it is to be understood that the subject matter defined in the appended claims is not necessarily limited to the specific features or acts described. Rather, the specific features and acts are disclosed as exemplary forms of implementing the claimed systems, methods, and structures.

One having ordinary skill in the art will appreciate that the size, shape and placement of such structures can be varied depending on the particular application. Apart from the functional aspects the structures provide, they also provide a novel decorative element. One having ordinary skill in the art will appreciate the decorative possibilities such shapes present.

The foregoing description, for purposes of explanation, has been described with reference to specific examples. However, the illustrative discussions above are not intended to be exhaustive or to limit the disclosure to the precise forms disclosed. Many modifications and variations are possible in view of the above teachings. The examples were chosen and described in order to best explain the principles of the disclosure and its practical applications, to thereby enable others skilled in the art to best utilize the disclosure and various examples with various modifications as may be suited to the particular use contemplated.

What is claimed is:

1. A cosmetic dispenser comprising:

a base comprising an interior surface that forms a spiral recess, an upper portion of the base being configured to releasably connect to a lid, wherein the base is a one-piece base;

a pedestal assembly at least partially received within a cavity formed by the base, the pedestal assembly comprising a pedestal comprising a base plate at a first distal end of the pedestal and a cup member at a second distal end opposite the first distal end, wherein the cup member is configured to receive a cosmetic that extends above the cup member; and a sleeve movably received at least partially within the cavity, the sleeve comprising at least one engaging component rotatably coupled to the base via the spiral recess, wherein the engaging component is configured to move along the spiral recess to raise and lower the sleeve, wherein the sleeve is configured to completely surround the cosmetic in a raised first position, and wherein the sleeve is configured to at least partially expose the cosmetic in a lowered second position.

2. The cosmetic dispenser of claim 1, wherein the pedestal and the base form a solid machined component.

3. The cosmetic dispenser of claim 1, wherein the cup member is removably attached to the pedestal.

4. The cosmetic dispenser of claim 3, wherein:

the cup member comprises a receiving component configured to mate with the second distal end of the pedestal; or the cup member comprises a threading component configured to couple with a thread around the second distal end of the pedestal.

5. The cosmetic dispenser of claim 1, wherein the base plate is configured to seat on a bottom floor of the cavity.

6. The cosmetic dispenser of claim 1, wherein at least one of the sleeve is transparent or the cup member is transparent.

7. The cosmetic dispenser of claim 1, further comprising the lid configured to mate with the base.

8. The cosmetic dispenser of claim 7, wherein the lid is transparent.

9. The cosmetic dispenser of claim 1, wherein at least one of the base, the pedestal, the base plate, the cup member, or the sleeve comprises at least one material comprising one or more of a biodegradable material, a recycled material, a recyclable material, an environmentally friendly material, polyhydroxyalkanoate (PHA), composites of any of the foregoing, laminates of any of the foregoing, or combinations of any of the foregoing.

10. The cosmetic dispenser of claim 9, wherein the at least one material is transparent.

11. The cosmetic dispenser of claim 1, wherein at least one of the base, the pedestal, the base plate, the cup member or the sleeve comprises a material comprising at least one of a polymer, paper, metal, glass, foam, fabric, composites of any of the foregoing, laminates of any of the foregoing, or combinations of any of the foregoing.

12. The cosmetic dispenser of claim 11, wherein the material comprises a polymer comprising at least one of an elastomer, an oriented polyester, an un-oriented polyesters a co-polyester, polyethylene terephthalate (PET), polyethylene terephthalate glycol (PETG), polyethylene furanoate (PEF), polybutylene terephthalate (PBT), polylactic acid (PLA), a nylon, a polyamide, polyethylene, polypropylene, a cellulose, a cellulosic ester, polyhydroxyalkanoate (PHA), polyvinyl chloride (PVC), ionomers, sodium ionomer, zinc ionomer, thermoplastic starch, a polyolefin, a cyclic polyolefin, a linear low density polyethylene (LLDPE), a low density polyethylene (LDPE), a high density polyethylene (HDPE), a medium density polyethylene (MDPE), polyoxymethylene (POM), polyphenylene sulfide (PPS), polyetherketone (PEK), ethylene vinyl acetate (EVA), ethylene acrylic acid (EAA), polyether ether ketone (PEEK), a homopolymer, a copolymer, blends thereof, combinations thereof, laminates thereof, microlayers thereof, nanolayers thereof, or coextrusions thereof.

13. The cosmetic dispenser of claim 11, wherein the material comprises a paper comprising at least one of a plant material, cardboard, paperboard, pressed paper, wax paper, paper Mache, wood fiber, cellulose, sawdust, hemp, hemp fiber, laminates thereof, composites thereof, or combinations thereof.

14. The cosmetic dispenser of claim 11, wherein the material comprises a metal comprising at last one of aluminum, tin, stainless steel, ceramics, metal oxides, silica, alumina, alloys thereof, anodized metals thereof, laminates thereof, or combinations thereof.

15. The cosmetic dispenser of claim 14, wherein the metal is comprised in a mixture with at least one of paper or a polymer, and wherein the mixture is at least one of biodegradable, recyclable, or environmentally friendly.

16. The cosmetic dispenser of claim 11, wherein the material comprises a glass comprising at least one of strengthened glass, reinforced glass, silica glass, aluminosilicate glass, borosilicate glass, tempered glass, or combinations thereof.

17. The cosmetic dispenser of claim 16, wherein the glass is comprised in a mixture with at least one of paper, a metal, or a polymer, and wherein the mixture is at least one of biodegradable, recyclable, or environmentally friendly.

18. The cosmetic dispenser of claim 11, wherein the fabric comprises at least one of woven materials, non-woven materials, cotton, wool, hemp, rayon, polyester, paper and fiber combinations, laminates thereof, or combinations thereof.

19. A lipstick dispenser comprising:

a base comprising an inner surface that forms a base feature, wherein an upper surface of the base is configured to releasably connect to a lid, wherein the base is a one-piece base;

a pedestal assembly comprising a first distal end disposed in a cavity formed by the base, the pedestal assembly further comprising a second distal end configured to secure lipstick; and a sleeve at least partially disposed in the cavity around at least a portion of the pedestal assembly, an outer surface of the sleeve comprising a sleeve feature that is configured to rotatably interface with the base via the base feature to move the sleeve between a first position to surround the lipstick and a second position to expose at least a portion of the lipstick.

20. The lipstick dispenser of claim 19, wherein at least one of: the sleeve is transparent; or at least a corresponding portion of the pedestal assembly is transparent.

* * * * *